US009344791B2

(12) United States Patent
Zhao et al.

(10) Patent No.: US 9,344,791 B2
(45) Date of Patent: May 17, 2016

(54) MUSIC EARPHONE

(75) Inventors: Yong David Zhao, Changshu (CN); Jinping Jennifer Zhao, Changshu (CN); Kun Yan, Changshu (CN)

(73) Assignee: JIANGSU BETTERLIFE MEDICAL CO., LTD, Changshu (CN)

( * ) Notice: Subject to any disclaimer, the term of this patent is extended or adjusted under 35 U.S.C. 154(b) by 0 days.

(21) Appl. No.: 14/378,979

(22) PCT Filed: Mar. 26, 2012

(86) PCT No.: PCT/CN2012/000373

§ 371 (c)(1),
(2), (4) Date: Aug. 15, 2014

(87) PCT Pub. No.: WO2013/123626

PCT Pub. Date: Aug. 29, 2013

(65) Prior Publication Data

US 2015/0249877 A1 Sep. 3, 2015

(30) Foreign Application Priority Data

Feb. 21, 2012 (CN) ..... 2012 1 0038818

(51) Int. Cl.

| | |
|---|---|
| ***H04R 1/02*** | (2006.01) |
| ***H04R 1/10*** | (2006.01) |
| *H04R 1/12* | (2006.01) |

(52) U.S. Cl.

CPC ..... *H04R 1/1058* (2013.01); *H04R 1/1016* (2013.01); *H04R 1/12* (2013.01); *H04R 2460/11* (2013.01)

(58) Field of Classification Search

CPC ..... H04R 25/654; H04R 2225/77; H04R 2460/09; H04R 2460/11; H04R 1/288; H04R 1/2823; H04R 1/2826; A61F 2011/085

See application file for complete search history.

(56) References Cited

U.S. PATENT DOCUMENTS 4,867,267 A * 9/1989 Carlson ..... H04R 25/654 381/325

(Continued)

FOREIGN PATENT DOCUMENTS

CN 101026904 A 8/2007
CN 101874410 A 10/2010

OTHER PUBLICATIONS

International Search Report of PCT Patent Application No. PCT/CN2012/000373 issued on Nov. 15, 2012.

*Primary Examiner* — Curtis Kuntz
*Assistant Examiner* — Ryan Robinson

(57) ABSTRACT

The present disclosure discloses a music earphone, which comprises an auricle-shaped shell, a cover, and a cavity formed by the auricle-shaped shell and the cover. A receiver(s) is disposed in the cavity, a sound aperture is disposed at an upper end of the shell, an edge of the sound aperture extends towards the interior of the cavity to form a cylindrical hearing tube, a lower end of the hearing tube is fixedly connected with the receiver(s), and a lower end of each of the receiver(s) is connected with a conductor. The music earphone allows the shell to match the auricle of a user in a breathable manner, filter out the external noise while still enabling the user to hear the external communication sound, improve the music quality, and guard the traffic safety of the user.

9 Claims, 3 Drawing Sheets

(56) References Cited

U.S. PATENT DOCUMENTS

| | | | | |
|---|---|---|---|---|
| 4,987,597 | A * | 1/1991 | Haertl | H04R 25/654 381/325 |
| 5,949,896 | A | 9/1999 | Nageno et al. | |
| 6,549,635 | B1 * | 4/2003 | Gebert | H04R 25/456 381/322 |
| 6,738,487 | B1 * | 5/2004 | Nageno | H04R 1/1016 381/312 |
| 6,879,697 | B2 * | 4/2005 | Topholm | H04R 25/658 181/135 |
| 7,079,662 | B2 * | 7/2006 | Niederdrank | H04R 25/652 381/322 |
| 7,240,765 | B2 * | 7/2007 | Berg | A61F 11/08 181/129 |
| 7,424,122 | B2 * | 9/2008 | Ryan | H04R 25/456 381/322 |
| 8,265,316 | B2 * | 9/2012 | Saltykov | H04R 25/456 381/325 |
| 2003/0123687 | A1 * | 7/2003 | Petrick | H04R 25/60 381/322 |

* cited by examiner

MUSIC EARPHONE

FIELD OF THE INVENTION

The present disclosure relates to the technical field of earphones, and more particularly, to a music earphone.

BACKGROUND OF THE INVENTION

Currently in the market, most of music earphones used with music players (e.g., MP3, iPod, iPhone, iPad, Smart Phone, computers or the like) are of the general type that is plugged into the users' ears, and are adapted to satisfy the general demands for music playing and listening. Because the general type of earplugs cannot match auricles of different individuals both in form and in size, leakage of the sound pressure will occur to cause a poor music effect if the earplugs cannot be plugged tightly. On the other hand, if the earphone is plugged into the auricle with a great force to reduce the sound pressure leakage, then uncomfortable feelings such as pains and fullness will be caused.

A fraction of earphones currently available in the market are customized so that the earphones can match the users' auricles in form and in size to improve the tightness and, therefore, to directly improve the music effect. Meanwhile, the receivers in the earphones can be put further into the ear canal to be closer to the ear drum so that the music effect of the earphones can get further improved. The customized earphones are mostly targeted to music fans who lay emphasis on the music effect. The customized earphones are made on a personalized basis through a process of firstly extracting an ear print of the earphone user, fabricating an earphone shell according to the ear print, then putting the receiver into the shell and connecting the receiver with a conductor, and finally putting on a cover to seal the earphone. Manufacturers including Ultimate Ear, Westone, Logitech all produce such customized earphones. However, such customized earphones still have problem of being unable to satisfy the market demands in the following respects:

a) Because the shell thereof makes close contact with the ear canal, a feeling of fullness tends to be caused to affect the music quality;

b) Also because the shell makes close contact with the ear canal in an airtight manner, anaphylaxis of the ear canal tends to occur after a long time of use;

c) Because the shell is too large to extend into the second curve of the ear canal, the long distance from the receiver to the ear drum increases the gain loss of the earphone, which will affect the music effect;

d) Because the earphone makes too close contact with the wall of the ear canal to closely block the ear canal, the user cannot hear the sound from the ambient, which might cause traffic safety problems; and e) If the earphone is chosen to make loose contact with the wall of the ear canal, the problem of ear fullness due to air tightness can be solved, but the music quality will be greatly compromised due to introduction of the ambient noise.

SUMMARY OF THE INVENTION

A primary objective of the present disclosure is to provide a music earphone, which can allow a shell to match an auricle of a user in a breathable manner, improve the music quality and guard the traffic safety of the user.

To solve the aforesaid technical problem, a technical solution adopted in the present disclosure is to provide a music earphone, which comprises an auricle-shaped shell, a cover, and a cavity formed by the auricle-shaped shell and the cover. One or more receivers are disposed in the cavity, a sound aperture is disposed at an upper end of the shell, an edge of the sound aperture extends towards the interior of the cavity to form a cylindrical hearing tube, a lower end of the hearing tube is fixedly connected with the receiver(s), a lower end of each of the receiver(s) is connected with a conductor, an upper end surface of the shell and the cover are formed with a first vent hole and a second vent hole communicating with the first vent hole via a vent tube respectively, a noise filtering core is disposed inside the vent tube, and the first vent hole on the upper end surface of the shell is provided with a guard screen. In an exemplary embodiment, because the vent tube itself is a porous tube formed with a plurality of pores having a bore diameter of less than 0.5 mm, there is no need to fill a noise filtering core therein.

Preferably, the noise filtering core is of a multi-sectional structure, and is made of a special porous polymer selected from an ultrahigh molecular weight polyethylene (UHMW-PE), a high-density polyethylene (HDPE), polytetrafluoroethylene (PTFE), polypropylene (PP), polyvinylidene fluoride (PVDF), nylon, polyethersulfone (PES), or a mixture thereof.

Preferably, a sound aperture protective screen is disposed on the sound aperture.

Preferably, a door is disposed on the cover at a position corresponding to the second vent hole, and the door is of a flip-over type or a sliding type.

Preferably, the vent tube is disposed inside the cavity in a helical form or in a curved form that extends along an inner wall of the shell.

Preferably, the vent tube is disposed inside a wall of the shell in a helical form, a linear form or a curved form.

Preferably, the shell is a soft shell, and the soft shell is one of the ITE-half shell type, the ITC type, the CIC type and the customized general type, and the soft shell is made of one or more soft polymer materials selected from a silicone rubber, polyurethane, a thermoplastic polyurethane (TPU) rubber, a thermoplastic elastomer, or polymers of silicone and polyurethane.

The present disclosure has the following benefits: the present disclosure provides a music earphone, which can allow a shell to match an auricle of a user in a breathable manner, improve the music quality and guard the traffic safety of the user.

DETAILED DESCRIPTION OF THE INVENTION

Hereinbelow, the preferred embodiments of the present disclosure will be detailed with reference to the drawings to make advantages and features of the present disclosure more apparent to those skilled in the art so that the protection scope of the present disclosure can be defined more explicitly.

Figure 1:
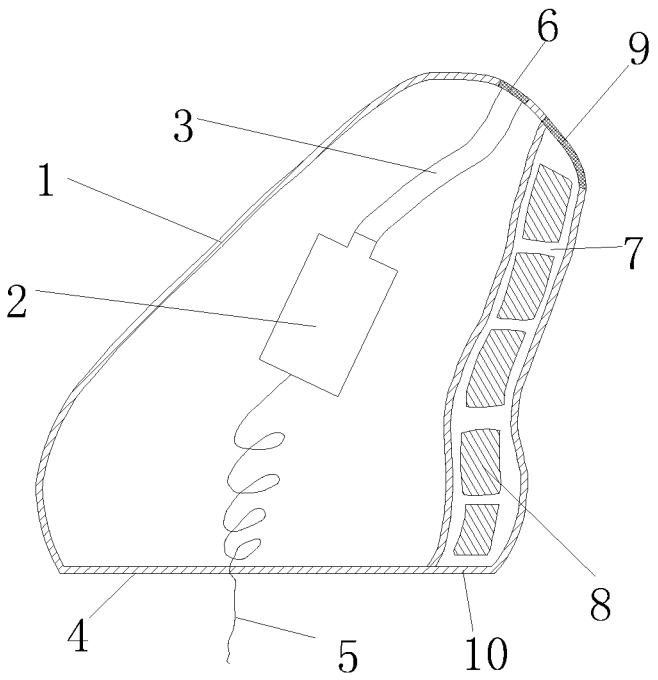
FIG. 1 is a schematic structural view of a music earphone according to a preferred embodiment of the present disclosure.
Figure 2:
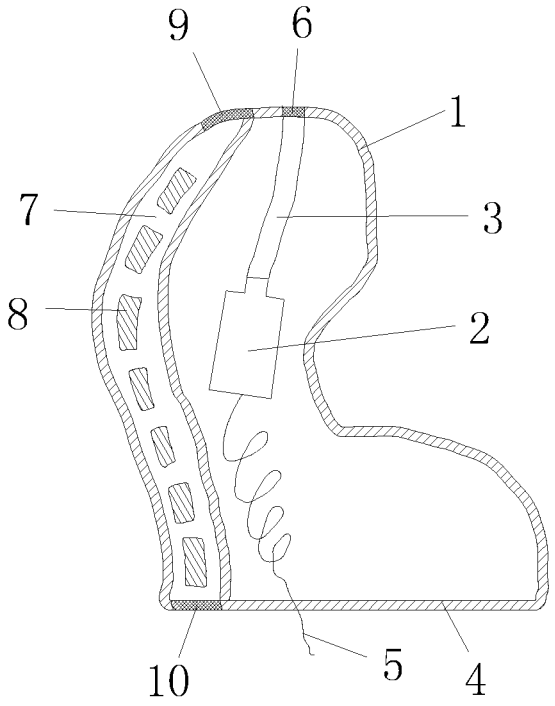
FIG. 2 is a schematic structural view of a music earphone according to another preferred embodiment of the present disclosure.
Figure 3:
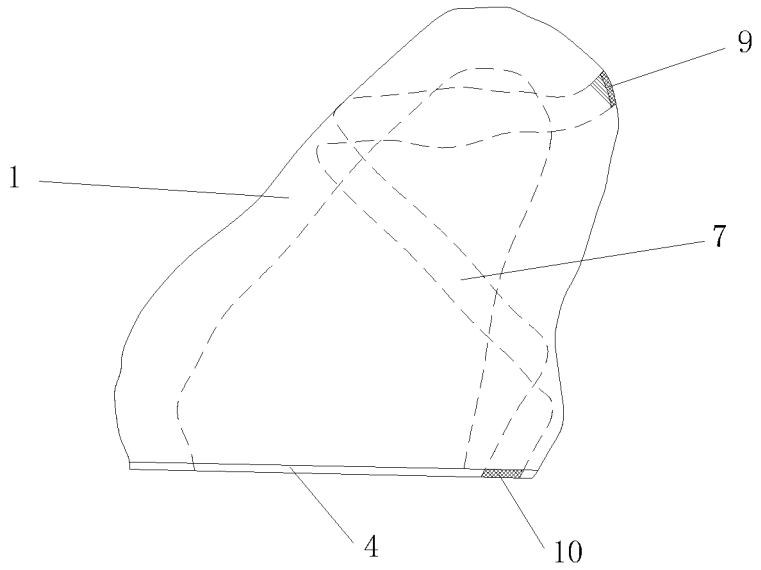
FIG. 3 is a schematic structural view of a vent tube of a music earphone according to the present disclosure.
Figure 4:
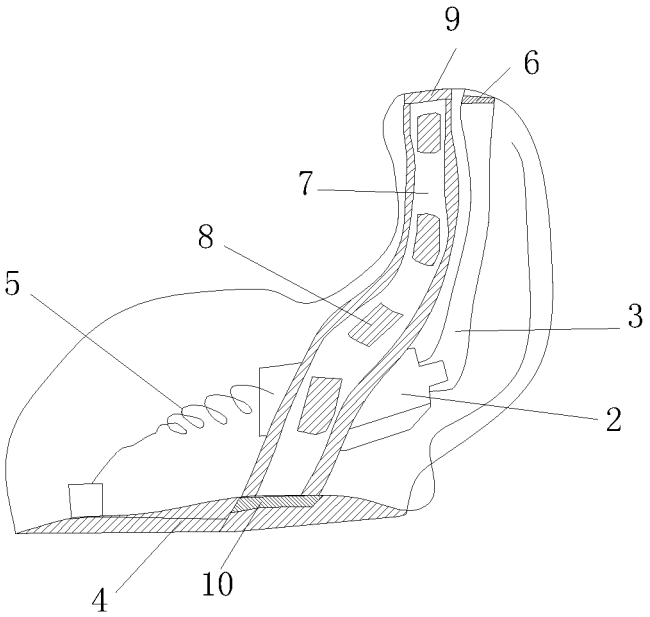
FIG. 4 is a schematic structural view of a music earphone according to still another preferred embodiment of the present disclosure.
Figure 5:
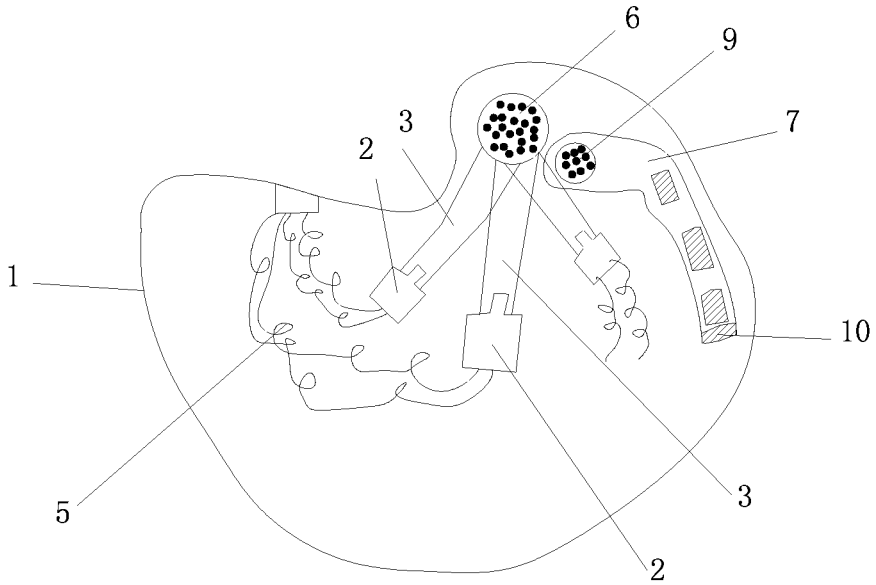
FIG. 5 is a schematic structural view of a music earphone according to a further preferred embodiment of the present disclosure.
Figure 6:
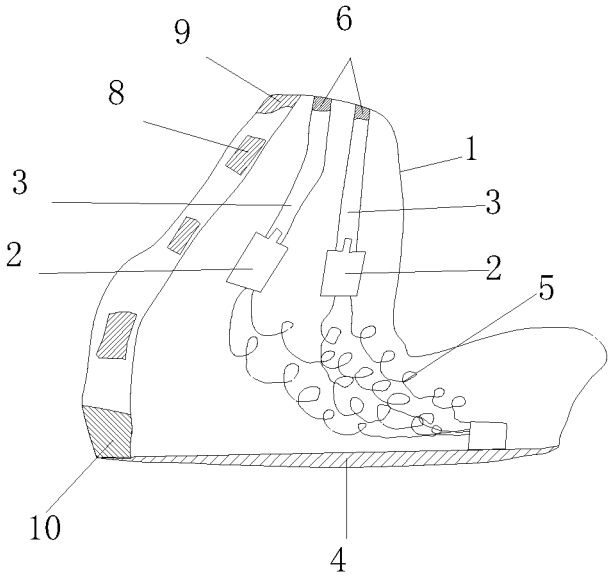
FIG. 6 is a schematic structural view of a music earphone according to a still further preferred embodiment of the present disclosure.

Referring to FIG. 1 to FIG. 6, embodiments of the present disclosure will be described as follows.

A music earphone comprises an auricle-shaped shell, a cover, and a cavity formed by the auricle-shaped shell and the cover. One or more receivers are disposed in the cavity, a sound aperture is disposed at an upper end of the shell, an edge of the sound aperture extends towards the interior of the cavity to form a cylindrical hearing tube, a lower end of the hearing tube is fixedly connected with the receiver(s), a lower end of each of the receiver(s) is connected with a conductor, an upper end surface of the shell and the cover are formed with a first vent hole and a second vent hole communicating with the first vent hole via a vent tube respectively, a noise filtering core is disposed inside the vent tube, the first vent hole on the upper end surface of the shell is provided with a guard screen, and a door is disposed or not disposed on the cover at a position corresponding to the second vent hole, and the door is of a flip-over type or a sliding type.

(I) The shell of the present disclosure is a customized soft shell. There are the following four methods to make the customized earphone soft cover, and the four methods may also be used in combination to make the cover of the earphone into a soft cover of a general type, which may be one of the ITE-half shell type, the ITC type, and the CIC type, and may be of a large size, a medium size, a small size or other different sizes.

1. There is no need to extract an ear print, and a soft polymer material (the soft polymer material is one or more of a silicone rubber, polyurethane, a TPU rubber, a TPE or polymers of silicone and polyurethane) is directly injected into the ear canal of the user for instant molding so that a soft cover can be fabricated on site.

2. An ear print is extracted firstly, and then a soft polymer material is used to fabricate a soft cover according to the ear print. The soft polymer material is one or more of a silicone rubber, polyurethane, a TPU rubber, a TPE or polymers of silicone and polyurethane.

3. An ear print is extracted firstly, and then a hard polymer material is used to fabricate a hard cover according to the ear print and a soft material coating is further coated on the outer surface of the hard cover. The hard polymer material may be one or more of acrylonitrile butadiene styrene (ABS), polypropylene (PP), polyethylene (PE), polycarbonate (PC) or polymers of PC/ABS. The soft material is one or more of a silicone rubber, polyurethane, a TPU rubber, a TPE or polymers of silicone and polyurethane.

4. Alternatively, an earphone cover is fabricated according to principles of fabricating the shell of a flexible CIC-type audiphone, and a soft ear mold is disposed at an end portion of the cover. The hard cover of the earphone may also be fabricated into a size slightly smaller than that of the auricle according to the CIC method for fabricating a customized hard cover; and then, one or more elastic rubber rings for sealingly contacting the wall of the ear canal are disposed around the cover. The material of the elastic rings is one or more of a silicone rubber, polyurethane, a TPU rubber, a TPE or polymers of silicone and polyurethane.

(II) A noise filtering core of a multi-sectional structure is disposed inside a breather tube.

1. In order to improve the breathability, more than one communicating mini breather tubes or vent tubes are disposed inside the earphone to filter out the ambient noise while allowing the air to circulate between the interior and the exterior of the ear. The breather tube may be one or more kinds of tubes that extend through the shell, through a wall of the shell, or along the outer wall of the shell. The vent tube may be of a linear form, or of a regular or irregular curved or helical form. The breather tube may be in a circular shape, an oval shape, a triangular shape, a quadrangular shape, or a polygonal shape. The maximum radial dimension is 0.3 mm to 0.5 mm, and the minimum radial dimension is no less than 0.1 mm. The vent tube may be hollow, or may be filled with a noise filtering core. In a special case where the diameter of the vent tube is less than 1.0 mm, the ambient noise can be effectively filtered out even when no filtering core is filled inside the vent tube.

2. No less than one vent tube is disposed to connect the openings at two ends of the cover respectively, and the wall of the tube(s) and the vent tube(s) are bonded sealingly together by means of an adhesive to prevent air leakage. The material of the vent tube(s) is one or more of the aforesaid soft or hard materials. The cross-sectional shape of the vent tube(s) may be any one of the aforesaid vent hole shapes, and may be the same as or different from the vent hole shapes, and the maximum inner diameter thereof is 0.5 mm to 4.5 mm and the thickness of the wall thereof is 0.1 mm to 2.0 mm.

3. In an alternative method of filtering out the noise, one or more noise filtering core sections are filled inside the vent tube to keep certain degrees of breathability while filtering out the ambient noise. The noise filtering core is made of a special porous polymer (the maximum radial dimension of pores is less than 0.5 mm) selected from an ultrahigh molecular weight polyethylene (UHMW-PE), a high-density polyethylene (HDPE), polytetrafluoroethylene (PTFE), polypropylene (PP), polyvinylidene fluoride (PVDF), nylon 6, polyethersulfone (PES), or a mixture thereof. The cross-sectional shape of the noise filtering core may be circular, oval, triangular, quadrangular, or polygonal. The breathability of the core (i.e., the damping factor to the sound wave transmission, or the frequency and loudness of the external noise to be filtered) depends on the size, the shape and the distribution density of the pores of the filtering core, the diameter and length of the core, the matching degree between the shape and size of the core and the shape and size of the vent tube, and so on. The multi-sectional filtering core comprises a plurality of cores having different pores, different diameters and different lengths, and the plurality of cores are arranged into one line (i.e., in series) or a plurality of lines (i.e., in parallel) in sequence according to their effective filtering frequency values or not in sequence. In this way, the ambient noise of various frequencies (50 Hz to 20000 Hz) and loudness (10 dB to 200 dB) can be filtered out. One testing method to determine the effective noise filtering range of the filtering core is to, by using an audiphone analyzer or an analyzer related to the acoustics, perform experimental calibration directly or indirectly on frequencies and loudness of given ambient noises according to the core material, the size and density of the pores as well as the diameter and length of the core.

(III) A door is disposed or not disposed on the cover at a position corresponding to the second vent hole.

1. As an option for the user, a door that can be opened or closed may be installed on the cover at a position corresponding to the vent hole.

2. The door may be opened or closed manually or electrically.

3. The opening and closing of an electric door may be driven by a micro piezo-electric element. For example, a fixed baffle is disposed to the exterior of the opening, and a plurality of pores are formed on the fixed baffle; and an movable baffle is disposed in the opening and in close proximity to the exterior baffle, and a plurality of pores similar to those of the fixed baffle are also formed on the movable baffle. The movable baffle can move linearly or rotate in a certain preset direction along the baffle surface so that the pores on the two baffles are offset from each other with a result that the pores of the fixed baffle are blocked by solid portions of the movable baffle. A piezo-electric element is connected to the movable baffle to directly drive motion of the movable baffle.

4. The weak direct-current power supply required by the piezo-electric element is provided by the power supply of a music player. One end of a power line is connected with the piezo-electric element and the other end of the power line is connected with the earphone plug, and the plug can be plugged into the player to connect with the power supply. A power switch that is controlled manually or wirelessly is disposed on the power line.

According to the above descriptions, a micro receiver of a CIC-type earphone can extend deep into the second curve of the ear canal and keep a close distance from the ear drum, and a soft ear mold is disposed at an end portion of the cover like the flexible CIC-type audiphone. The soft ear mold can fix the earphone inside the ear canal while providing breathability inside the ear canal. Alternatively, if the user does not like the earphone wire in case of the wired connection, he or she can adopt the wireless Bluetooth technology to connect the earphone with the music player wirelessly. For this purpose, a Bluetooth module is added into the earphone so that communication between the Bluetooth module and a Bluetooth component in the music player can be achieved through wireless connection, and a fully automatic operation can be achieved wirelessly.

As a low-impedance conductor and plug technology, thin metal wires (with a diameter of 0.001 mm to 2.0 mm) that are made of materials having low impedance, good toughness, and corrosion resistance such as silver, platinum, MP35N, MP-DFT-Ag, titanium alloys, Nitinol and the like are used to make the earphone conductor or earphone cable; and the plug may also be made of the same material as the conductor.

What described above are only the embodiments of the present disclosure, but are not intended to limit the scope of the present disclosure. Any equivalent structures or equivalent process flow modifications that are made according to the specification and the attached drawings of the present disclosure, or any direct or indirect applications of the present disclosure in other related technical fields shall all be covered within the scope of the present disclosure.

What is claimed is:

1. A music earphone, comprising an auricle-shaped shell, a cover, and a cavity formed by the auricle-shaped shell and the cover, wherein one or more receivers are disposed in the cavity, a sound aperture is disposed at an upper end of the shell, an edge of the sound aperture extends towards the interior of the cavity to form a cylindrical hearing tube, a lower end of the hearing tube is fixedly connected with the receiver(s), a lower end of each of the receiver(s) is connected with a conductor, an upper end surface of the shell and the cover are formed with a first vent hole and a second vent hole communicating with the first vent hole via a vent tube respectively, a noise filtering core is disposed inside the vent tube, and the first vent hole on the upper end surface of the shell is provided with a guard screen, the noise filtering core is of a multi-sectional structure, and comprises a plurality of cores having different pores, different diameters and different lengths, and the plurality of cores are arranged into one line or a plurality of lines in sequence according to their effective filtering frequency values or not in sequence;

wherein a door is disposed on the cover at a position corresponding to the second vent hole, and the door is of a flip-over type or a sliding type;

wherein a fixed baffle is disposed to the exterior of the opening, and a plurality of pores are formed on the fixed baffle; and a movable baffle is disposed in the opening and in close proximity to the exterior baffle, and a plurality of pores similar to those of the fixed baffle are also formed on the movable baffle, the movable baffle moves linearly or rotates in a certain preset direction along the baffle surface so that the pores on the two baffles are offset from each other with a result that the pores of the fixed baffle are blocked by solid portions of the movable baffle.

2. The music earphone of claim 1, wherein the noise filtering core is made of a special porous polymer selected from an ultrahigh molecular weight polyethylene (UHMW-PE), a high-density polyethylene (HDPE), polytetrafluoroethylene (PTFE), polypropylene (PP), polyvinylidene fluoride (PVDF), nylon, polyethersulfone (PES), or a mixture thereof.

3. The music earphone of claim 1, wherein a sound aperture protective screen is disposed on the sound aperture.

4. The music earphone of claim 1, wherein the vent tube is disposed inside the cavity in a helical form or in a curved form that extends along an inner wall of the shell.

5. The music earphone of claim 1, wherein the vent tube is disposed inside a wall of the shell in a helical form, a linear form or a curved form.

6. The music earphone of claim 1, wherein the shell is a hard shell or a soft shell and is one of the ITE-half shell type, the ITC type, the CIC type and the customized general type, and the soft shell is made of one or more soft polymer materials selected from a silicone rubber, polyurethane, a thermoplastic polyurethane (TPU) rubber, a thermoplastic elastomer, or polymers of silicone and polyurethane.

7. The music earphone of claim 1, wherein a piezo-electric element is connected to the movable baffle to directly drive motion of the movable baffle.

8. The music earphone of claim 1, wherein the vent tube extends along an outer wall of the shell.

9. The music earphone of claim 1, a breathability of the core depends on the size, the shape and the distribution density of the pores of the filtering core, the diameter and length of the core, the matching degree between the shape and size of the core and the shape and size of the vent tube.

* * * * *